US009048554B2

(12) United States Patent
Tagawa et al.

(10) Patent No.: US 9,048,554 B2
(45) Date of Patent: Jun. 2, 2015

(54) ELECTRICAL CONNECTOR FOR USE WITH A CIRCUIT BOARD

(71) Applicant: DAI-ICHI SEIKO CO., LTD., Kyoto (JP)

(72) Inventors: Tetsuya Tagawa, Tokyo (JP); Masatoshi Takemoto, Tokyo (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 16 days.

(21) Appl. No.: 13/875,013

(22) Filed: May 1, 2013

(65) Prior Publication Data

US 2013/0309881 A1 Nov. 21, 2013

(30) Foreign Application Priority Data

May 17, 2012 (JP) ..... 2012-113734

(51) Int. Cl.

| | |
|---|---|
| ***H01R 12/00*** | (2006.01) |
| ***H01R 13/02*** | (2006.01) |
| ***H01R 12/57*** | (2011.01) |
| ***H01R 43/02*** | (2006.01) |
| ***H01R 12/70*** | (2011.01) |
| ***H01R 12/71*** | (2011.01) |
| ***H01R 13/6594*** | (2011.01) |
| ***H01R 13/6471*** | (2011.01) |
| ***H01R 13/6585*** | (2011.01) |
| ***H01R 13/6596*** | (2011.01) |

(52) U.S. Cl.

CPC ..... *H01R 13/02* (2013.01); *H01R 12/57* (2013.01); *H01R 43/0256* (2013.01); *H01R 12/707* (2013.01); *H01R 12/716* (2013.01); *H01R 13/6594* (2013.01); *H01R 13/6471* (2013.01); *H01R 13/6585* (2013.01); *H01R 13/6596* (2013.01)

(58) Field of Classification Search

USPC ..... 439/83, 65, 74, 607.35, 607.36

See application file for complete search history.

(56) References Cited

U.S. PATENT DOCUMENTS

| | | | | | |
|---|---|---|---|---|---|
| 4,718,867 | A | * | 1/1988 | Seidel et al. | 439/607.17 |
| 5,102,350 | A | * | 4/1992 | Janota et al. | 439/607.32 |
| 5,141,445 | A | * | 8/1992 | Little | 439/108 |
| 5,697,799 | A | * | 12/1997 | Consoli et al. | 439/181 |
| 6,039,583 | A | * | 3/2000 | Korsunsky et al. | 439/101 |
| 6,139,364 | A | * | 10/2000 | Beutler et al. | 439/607.01 |

(Continued)

FOREIGN PATENT DOCUMENTS

| | | |
|---|---|---|
| JP | 09-237656 | 9/1997 |
| JP | 2005322598 A | 11/2005 |

(Continued)

*Primary Examiner* — Neil Abrams
*Assistant Examiner* — Travis Chambers
(74) *Attorney, Agent, or Firm* — Studebaker & Brackett PC

(57) ABSTRACT

An electrical connector for use with a circuit board including an insulating housing used to be fixed to a circuit board, a plurality of signal contacts arranged on the insulating housing along a longitudinal direction of the same, at least one ground contact provided in an arrangement of the signal contacts on the insulating housing, and a conductive shell member provided for covering partially a portion of the insulating housing and to be connected with a grounding portion of the circuit board, wherein the conductive shell member has a ground connecting reed-like portion formed thereon so as to correspond to the ground contact and both of the ground connecting reed-like portion of the conductive shell member and the ground contact are connected by means of soldering with the grounding portion of the circuit board.

3 Claims, 10 Drawing Sheets

(56) References Cited

U.S. PATENT DOCUMENTS

| | | | | |
|---|---|---|---|---|
| 6,152,772 | A * | 11/2000 | Hara et al. | 439/607.01 |
| 6,247,969 | B1 * | 6/2001 | Niitsu | 439/607.01 |
| 6,264,480 | B1 * | 7/2001 | Nealis et al. | 439/92 |
| 6,394,841 | B1 * | 5/2002 | Matsuura | 439/607.23 |
| 6,461,175 | B2 * | 10/2002 | Okamoto | 439/92 |
| 6,939,148 | B2 * | 9/2005 | Yu | 439/92 |
| 7,165,994 | B2 * | 1/2007 | Ferry et al. | 439/607.34 |
| 7,431,617 | B2 * | 10/2008 | Yamaji | 439/607.17 |
| 7,445,506 | B2 * | 11/2008 | Ma | 439/607.01 |
| 7,467,975 | B2 * | 12/2008 | Ma | 439/607.01 |
| 7,585,185 | B2 * | 9/2009 | Obikane | 439/607.01 |
| 7,833,042 | B2 * | 11/2010 | Nishio et al. | 439/331 |
| 7,909,648 | B2 * | 3/2011 | Tai | 439/607.32 |
| 7,967,639 | B1 * | 6/2011 | Huang et al. | 439/607.35 |
| 8,272,881 | B2 * | 9/2012 | Miyazaki et al. | 439/74 |
| 8,764,488 | B2 * | 7/2014 | Zeng | 439/626 |
| 2008/0214051 | A1 * | 9/2008 | Obikane | 439/610 |
| 2013/0012039 | A1 * | 1/2013 | Nose et al. | 439/74 |
| 2014/0187059 | A1 * | 7/2014 | Takemoto | 439/65 |

FOREIGN PATENT DOCUMENTS

| | | | |
|---|---|---|---|
| JP | 2007-157594 | A | 6/2007 |
| JP | 2008-041285 | A | 2/2008 |
| JP | 2008097875 | A | 4/2008 |
| JP | 2008-112636 | A | 5/2008 |
| JP | 2008-147020 | A | 6/2008 |
| JP | 2010-113813 | A | 5/2010 |

* cited by examiner

ELECTRICAL CONNECTOR FOR USE WITH A CIRCUIT BOARD

BACKGROUND OF THE INVENTION

1. Field of the Invention

The present invention relates generally to an electrical connector for use with a circuit board, and more particularly to an improvement in an electrical connector used to be mounted on and connected electrically with a circuit board for coupling with a mate electrical connector mounted on another circuit board to be electrically connected with the same.

2. Description of the Prior Art Including Information Disclosed Under 37 CFR 1.97 and 37 CFR 1.98

Various kinds of electric or electronic parts are built even in a relatively small-sized electronic apparatus such as a portable telephone or the like. A major part of those parts are dispersedly mounted on, for example, a couple of separate circuit boards to fulfill their respective functions. In the relatively small-sized electronic apparatus, having an eye to the couple of separate circuit boards on which the electric or electronic parts are mounted, it is likely that one of the separate circuit boards is required to be laid on top of the other of the separate circuit boards for reducing a space occupied thereby when the separate circuit boards are electrically connected with each other. Such an electrical connection between the separate circuit boards wherein one is laid on top of the other is hereinafter referred to as an electrical piling connection.

In general, when a plurality of circuit boards, such as solid circuit boards, are electrically connected with one another, a plurality of electrical connectors are mounted on the circuit boards, respectively, and one of the electrical connectors is coupled with another electrical connector so as to connect one of the circuit boards electrically with another circuit board. In case of the electrical piling connection mentioned above, first and second electrical connectors are mounted respectively on the separate circuit boards to be coupled with each other. The first electrical connector is formed into a plug type connector and the second electrical connector is formed into a receptacle type connector to be a mate electrical connector for the first electrical connector, so that the plug type connector is engaged with the receptacle type connector when the separate circuit boards are put in a condition of the electrical piling connection.

In such a case, the plug type connector has an insulating housing provided to be fixed to one of the separated circuit boards and the receptacle connector has another insulating housing provided to be fixed to the other of the separated circuit boards. The insulating housing of the plug type connector is provided thereon with an engaging projection formed to elongate in a longitudinal direction of the insulating housing of the plug type connector to be inserted into an engaging groove formed on the insulating housing of the receptacle connector to elongate in a longitudinal direction of the insulating housing of the receptacle connector. The engaging projection formed on the insulating housing of the plug type connector and the elongating groove formed on the insulating housing of the receptacle type connector constitute jointly a pair of engaging portions operative to engage with each other.

As to one of the plug type and receptacle type connectors, for example, the plug type connector, the insulating housing of the plug type connector is provided thereon with a plurality of plug side signal contacts arranged along the engaging projection formed on the insulating housing of the plug type connector to be connected respectively with a plurality of signal terminals provided on the separate circuit board to which the insulating housing of the plug type connector is fixed (hereinafter, referred to as a plug side circuit board) and provided thereon also with a plug side ground contact to be connected with a ground terminal provided on the plug side circuit board. Such a plug type connector having the insulating housing on which the plug side signal contacts and the plug side ground contact are provided is usually provided further with a conductive shell member which covers partially the outside of the engaging projection formed on the insulating housing of the plug type connector and is connected with a grounding portion of the plug side circuit board including the ground terminal provided on the plug side circuit board so as to be supplied with a ground potential.

When the engaging projection formed on the insulating housing of the plug type connector is inserted into the engaging groove formed on the insulating housing of the receptacle type connector and thereby the plug type connector is coupled with the receptacle type connector, so that the plug side circuit board and the separate circuit board to which the insulating housing of the receptacle type connector is fixed (hereinafter, referred to as a receptacle side circuit board) are put in the condition of the electrical piling connection, the plug side signal contacts come into contact respectively with a plurality of receptacle side signal contacts, which are arranged along the engaging groove on the insulating housing of the receptacle type connector and connected respectively with a plurality of signal terminals provided on the receptacle side circuit board, to be electrically connected with the same, and the plug side ground contact comes into contact with a receptacle side ground contact, which is provided on the insulating housing of the receptacle type connector and connected with a ground terminal provided on the receptacle side circuit board, to be electrically connected with the same. As a result, the signal terminals provided on the plug side circuit board are electrically connected through the plug type and receptacle type connectors with the signal terminals provided on the receptacle side circuit board and the ground terminal provided on the plug side circuit board is electrically connected through the plug type and receptacle type connectors with the ground terminal provided on the receptacle side circuit board.

In such a plug type connector as described above, the conductive shell member has usually a pair of end portions in a direction along which the engaging projection formed on the insulating housing elongates (a direction along which the plug side signal contacts are arranged), each of which is electrically connected through a ground connecting portion thereof with the grounding portion of the plug side circuit board. With the end portions in the direction along which the engaging projection formed on the insulating housing elongates, each of which is connected through the ground connecting portion thereof with the grounding portion of the plug side circuit board, the conductive shell member is prevented from interfering with a condition wherein the plug side signal contacts arranged along the engaging projection formed on the insulating housing of the plug type connector are connected respectively with the signal terminals provided on the plug side circuit board.

In regard to the plug type connector thus provided with the conductive shell member having the end portions thereof in the direction along which the engaging projection formed on the insulating housing elongates, each of which is connected through the ground connecting portion thereof with the grounding portion of the plug side circuit board, it is feared that a middle portion of the conductive shell member located between the end portions of the conductive shell member in the direction along which the engaging projection formed on the insulating housing elongates is put at a position relatively distant from the grounding portion of the plug side circuit board and thereby a small potential difference arises between the middle portion of the conductive shell member and the grounding portion of the plug side circuit board when a high frequency signal transmitted through the plug side signal contact connected with the signal terminal provided on the plug side circuit board acts on the middle portion of the conductive shell member, so that a grounding characteristic of each of the plug side signal contacts corresponding to the middle portion of the conductive shell member is undesirably deteriorated. For dealing with such a problem, it is possible to provide an additional ground connecting portion on a portion other than the end portions of the conductive shell member. However, the ground connecting portions provided on the conductive shell member are severely restricted in their number and positions under a situation wherein the plug type connector is generally required to be miniaturized and therefore it is difficult to add the additional ground connecting portion to the conductive shell member having the end portions each including therein the ground connecting portion.

Under such a situation, there has been previously proposed an improved plug or receptacle type connector which is provided with a conductive shell member covering partially the outside of an insulating housing on which a plurality of plug or receptacle side signal contacts are arranged and in which not only a pair of end portions of the conductive shell member in a direction along which the plug or receptacle side contacts are arranged but also a plurality of portions located between the end portions of the conductive shell member are connected with a grounding portion of a circuit board to which the insulating housing is fixed, as disclosed in, for example, the Japanese patent application published before examination under publication number HEI 9-237656 (hereinafter, referred to as published prior art document JA).

In a plug type connector (1) disclosed in the published prior art document JA, a conductive shell member (shield (4)) is provided for covering partially the outside of an insulating housing (2) and some of a plurality of plug side signal contacts (terminals (3)) arranged on the insulating housing in a longitudinal direction of the same are operative to function as plug side ground contacts (ground terminals) connected with a grounding portion (a ground circuit) of a plug side circuit board (a printed circuit board).

A reed-like portion (9) is formed on each of portions of the conductive shell member corresponding respectively to the plug side ground contacts to be operative to come into press-contact with the plug side ground contact, so that the conductive shell member is electrically connected through the reed-like portions with the plug side ground contacts. As a result, the portions between a pair of the end portions of the conductive shell member in a direction along which the plug side signal contacts are arranged are connected through the plug side ground contacts with the grounding portion of the plug side circuit board.

Further, in a receptacle type connector (11) disclosed in the published prior art document JA, a conductive shell member (shield (14)) is provided for covering partially the outside of an insulating housing (12) and some of a plurality of receptacle side signal contacts (terminals (13)) arranged on the insulating housing in a longitudinal direction of the same are operative to function as receptacle side ground contacts (ground terminals) connected with a grounding portion (a ground circuit) of a receptacle side circuit board (a printed circuit board).

A reed-like portion (19) is formed on each of portions of the conductive shell member corresponding respectively to the receptacle side ground contacts to be operative to come into resilient press-contact with the plug side ground contact, so that the conductive shell member is electrically connected through the reed-like portions with the receptacle side ground contacts. As a result, the portions between a pair of the end portions of the conductive shell member in a direction along which the receptacle side signal contacts are arranged are connected through the receptacle side ground contacts with the grounding portion of the receptacle side circuit board.

In the previously proposed plug or receptacle type connector disclosed in the published prior art document JA wherein the portions between the end portions of the conductive shell member in the direction along which the plug or receptacle side signal contacts are arranged are connected with the grounding portion of the plug or receptacle side circuit board through the plug or receptacle side ground contacts with which the reed-like portions formed on the conductive shell member come into resilient press-contact respectively, since the electrical connection between the conductive shell member and the grounding portion of the plug or receptacle side circuit board is brought about with the reed-like portions formed on the conductive shell member put in resilient press-contact with the plug or receptacle side ground contacts, there is a disadvantage that reliability and stability in the electrical connection between the conductive shell member and the grounding portion of the plug or receptacle side circuit board are undesirably influenced by conditions of the resilient press-contact between each of the reed-like portions formed on the conductive shell member and the plug or receptacle side ground contact. For example, in the case where the reed-like portion formed on the conductive shell member is put in resilient press-contact with the plug or receptacle side ground contact without adequate pressure to the plug or receptacle side ground contact due to an improper mutual positional relationship between the reed-like portion and the plug or receptacle side ground contact or in the case wherein the reed-like portion formed on the conductive shell member is put in resilient press-contact with the plug or receptacle side ground contact with minute dust or dirt put between the reed-like portion and the plug or receptacle side ground contact, an electric resistance between the reed-like portion formed on the conductive shell member and the plug or receptacle side ground contact is increased so that a reliable and stable electrical connection between the conductive shell member and the grounding portion of the plug or receptacle side circuit board can not be obtained.

That is, with the previously proposed plug or receptacle type connector wherein the portions between the end portions of the conductive shell member in the direction along which the plug or receptacle side signal contacts are arranged are connected with the grounding portion of the plug or receptacle side circuit board through the plug or receptacle side ground contacts, it is feared that the electrical connection between the conductive shell member and the grounding portion of the plug or receptacle side circuit board is lacking in reliability and stability.

BRIEF SUMMARY OF THE INVENTION

Accordingly, it is an object of the present invention to provide an electrical connector for use with a circuit board, which has an insulating housing provided with a plurality of signal contacts and at least one ground contact arranged thereon and used to be fixed on a circuit board and a conductive shell member for covering partially the insulating housing, in which the signal contacts are operative to be connected respectively with a plurality of signal terminals provided on the circuit board on which the insulating housing is fixed, the ground contact is operative to be connected with a ground terminal provided on the circuit board on which the insulating housing is fixed, and the signal contacts come into contact respectively with a plurality of mate signal contacts of a mate electrical connector to be electrically connected with the same and ground contact comes into contact with a mate ground contact of the mate electrical connector to be electrically connected with the same when an engaging portion formed on the insulating housing is put in engagement with the mate electrical connector, and which avoids the aforementioned problem and disadvantage encountered with the prior art.

Another object of the present invention to provide an electrical connector for use with a circuit board, which has an insulating housing provided with a plurality of signal contacts and at least one ground contact arranged thereon and used to be fixed on a circuit board and a conductive shell member for covering partially the insulating housing, in which the signal contacts are operative to be connected respectively with a plurality of signal terminals provided on the circuit board on which the insulating housing is fixed, the ground contact is operative to be connected with a ground terminal provided on the circuit board on which the insulating housing is fixed, and the signal contacts come into contact respectively with a plurality of mate signal contacts of a mate electrical connector to be electrically connected with the same and ground contact comes into contact with a mate ground contact of the mate electrical connector to be electrically connected with the same when an engaging portion formed on the insulating housing is put in engagement with the mate electrical connector, and with which the conductive shell member is able to present a superior grounding characteristic to the signal contacts on the insulating housing.

A further object of the present invention to provide an electrical connector for use with a circuit board, which has an insulating housing provided with a plurality of signal contacts and at least one ground contact arranged thereon and used to be fixed on a circuit board and a conductive shell member for covering partially the insulating housing, in which the signal contacts are operative to be connected respectively with a plurality of signal terminals provided on the circuit board on which the insulating housing is fixed, the ground contact is operative to be connected with a ground terminal provided on the circuit board on which the insulating housing is fixed, and the signal contacts come into contact respectively with a plurality of mate signal contacts of a mate electrical connector to be electrically connected with the same and ground contact comes into contact with a mate ground contact of the mate electrical connector to be electrically connected with the same when an engaging portion formed on the insulating housing is put in engagement with the mate electrical connector, and with which a portion of the conductive shell member located between a pair of end portions of the same in a direction along which the signal contacts are arranged can be reliably and stably connected electrically with a grounding portion of the circuit board on which the insulating housing is fixed.

According to the present invention, there is provided an electrical connector for use with a circuit board, which comprises an insulating housing provided with an engaging projection formed thereon to elongate in a predetermined direction for engaging with a mate electrical connector and used to be fixed to a circuit board, a plurality of signal contacts arranged in the predetermined direction on the insulating housing, each of which has a signal connecting terminal provided to be connected with a signal terminal provided on the circuit board and a signal contacting portion put on the engaging projection formed on the insulating housing for coming into contact with a mate signal contact in the mate electrical connector, at least one ground contact provided in an arrangement of the signal contacts on the insulating housing, which has a ground connecting terminal provided to be connected with a ground terminal provided on the circuit board and a ground contacting portion put on the engaging projection formed on the insulating housing for coming into contact with a mate ground contact in the mate electrical connector, and a conductive shell member provided to cover partially a portion of the insulating housing positioned at the outside of the engaging projection formed on the insulating housing and to be connected with a grounding portion of the circuit board including the ground terminal provided on the circuit board. The conductive shell member thus provided has a ground connecting reed-like portion formed thereon to correspond to the ground connecting terminal of the ground contact, and the ground connecting reed-like portion of the conductive shell member and the ground connecting terminal of the ground contact are connected by means of soldering with the ground terminal provided on the circuit board to be common to both of the ground connecting reed-like portion of the conductive shell member and the ground connecting terminal of the ground contact.

In an embodiment of electrical connector for use with a circuit board according to the present invention, the ground contact is provided at each of locations at predetermined intervals in the arrangement of the signal contacts on the insulating housing and the ground connecting reed-like portion is formed on each of a plurality of portions of the conductive shell member each corresponding to the ground connecting terminal of the ground contact.

In the electrical connector for use with a circuit board thus constituted in accordance with the present invention, under a condition wherein at least one ground contact having the ground connecting terminal provided to be connected with the ground terminal provided on the circuit board to which the insulating housing is fixed is provided in the arrangement of the signal contacts on the insulating housing and the conductive shell member provided to cover partially the portion of the insulating housing positioned at the outside of the engaging projection formed on the insulating housing has the ground connecting reed-like portion formed thereon to correspond to the ground connecting terminal of the ground contact, the ground connecting reed-like portion of the conductive shell member and the ground connecting terminal of the ground contact are connected by means of soldering with the ground terminal provided on the circuit board to be common to both of the ground connecting reed-like portion of the conductive shell member and the ground connecting terminal of the ground contact. Thereby, the end portions of the conductive shell member in the direction along which the signal contacts are arranged on the insulating housing are electrically connected with the grounding portion of the circuit board to which the insulating housing is fixed and, in addition, a portion of the conductive shell member corresponding to the ground connecting terminal of the ground contact between the end portions of the conductive shell member is also electrically connected, together with the ground connecting terminal of the ground contact, through the grounding connecting portion formed on the conductive shell member with the ground terminal included in the grounding portion of the circuit board to which the insulating housing is fixed.

Especially, in one embodiment of electrical connector for use with a circuit board according to the present invention, a plurality of ground contacts are located at predetermined intervals in the arrangement of the signal contacts on the insulating housing and the ground connecting reed-like portion is formed on each of the portions of the conductive shell member each corresponding to the ground connecting terminal of the ground contact. Therefore, a plurality of ground connecting reed-like portions are provided at predetermined intervals on the conductive shell member to be electrically connected respectively with a plurality of ground terminals included in the grounding portion of the circuit board to which the insulating housing is fixed.

With the electrical connector for use with a circuit board according to the present invention, the conductive shell member provided for covering partially the outside of the engaging projection formed on the insulating housing has the ground connecting reed-like portion which is formed on the portion of the conductive shell member corresponding to the ground connecting terminal of the ground contact between the end portions of the conductive shell member in the direction along which the signal contacts are arranged so as to be electrically connected by means of soldering, together with the ground connecting terminal of the ground contact, with the ground terminal included in the grounding portion of the circuit board to which the insulating housing is fixed, so that the portion of the conductive shell member, on which the ground connecting reed-like portion is formed and which is located between the end portions of the conductive shell member in the direction along which the signal contacts are arranged, is supplied with a ground potential through the ground connecting reed-like portion from the ground terminal provided on the circuit board. Accordingly, the conductive shell member having the ground connecting reed-like portion thus provided can be put in a condition wherein the end portions of the conductive shell member in the direction along which the signal contacts are arranged are electrically connected with the grounding portion of the circuit board to which the insulating housing is fixed and, in addition, the portion of the conductive shell member, on which the ground connecting reed-like portion is formed and which is located between the end portions of the conductive shell member in the direction along which the signal contacts are arranged, is electrically connected with the ground terminal included in the grounding portion of the circuit board, so that the conductive shell member is supplied with the ground potential at the end portions thereof in the direction along which the signal contacts are arranged and the portion thereof located between the end portions. This results in that the conductive shell member presents a superior grounding characteristic to the signal contacts on the insulating housing.

Further, with the electrical connector for use with a circuit board according to the present invention, since the ground connecting reed-like portion is formed on the portion of the conductive shell member corresponding to the ground connecting terminal of the ground contact put on the insulating housing to be electrically connected by means of soldering, together with the ground connecting terminal of the ground contact, with the ground terminal provided to be common to the ground connecting reed-like portion of the conductive shell member and the ground connecting terminal of the ground contact on the circuit board to which the insulating housing is fixed and thereby the portion of the conductive shell member, on which the ground connecting reed-like portion is formed and which is located between the end portions of the same in the direction along which the signal contacts are arranged, is electrically connected with the grounding portion of the circuit board, the portion of the conductive shell member, on which the ground connecting reed-like portion is formed and which is located between the end portions of the same in the direction along which the signal contacts are arranged, can be reliably and stably connected electrically with the grounding portion of the circuit board on which the insulating housing is fixed.

Besides, with the electrical connector for use with a circuit board according to the present invention, since each of the ground connecting terminal of the ground contact and the ground connecting reed-like portion of the conductive shell member is not subjected to any positional restriction in the arrangement of the signal contacts, an optional portion of the conductive shell member selected in response to a position of the ground terminal included in the grounding portion of the circuit board to which the insulating housing is fixed can be electrically connected with the grounding portion of the circuit board.

The above, and other objects, features and advantages of the present invention will become apparent from the following detailed description taken in conjunction with the accompanying drawings.

DETAILED DESCRIPTION OF THE INVENTION

Figure 1:
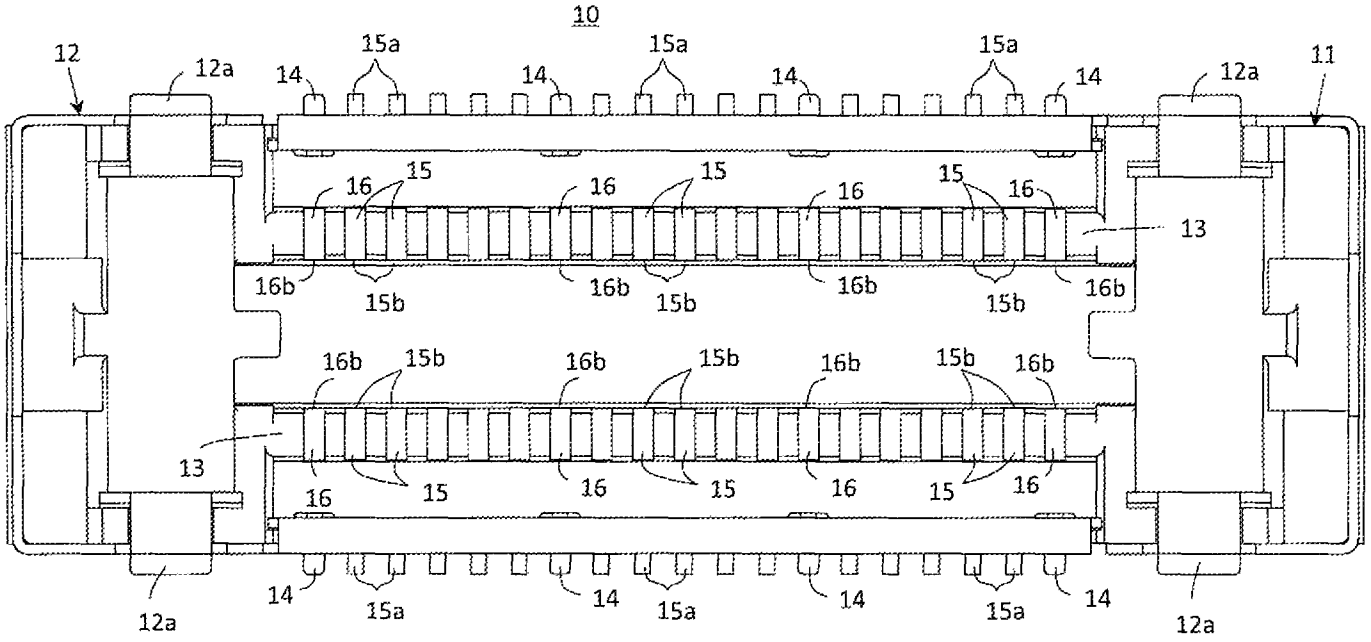
FIG. 1 is a schematic plan view showing an embodiment of electrical connector for use with a circuit board according to the present invention.
Figure 2:
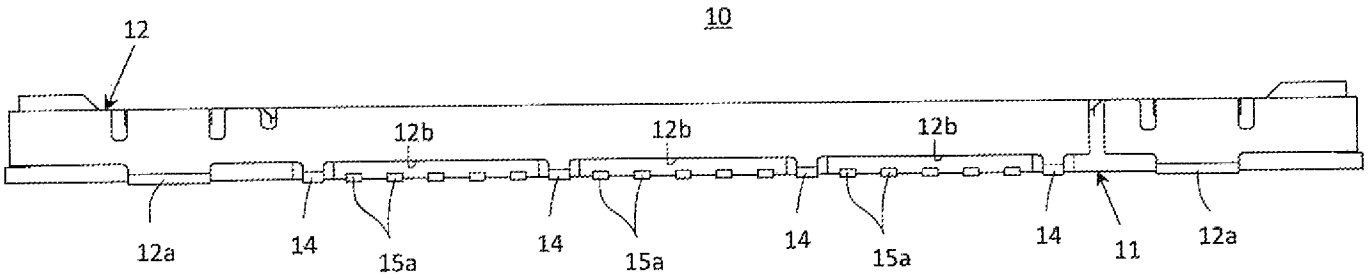
FIG. 2 is a schematic front view showing an embodiment of electrical connector for use with a circuit board according to the present invention.

FIGS. 1 and 2 show an embodiment of electrical connector for use with a circuit board according to the present invention.

Referring to FIGS. 1 and 2, an electrical connector 10, which constitutes the embodiment of electrical connector for use with a circuit board according to the present invention, is provided to be used as a plug type connector mounted on a circuit board on which an electric circuit is constituted. When the electrical connector 10 is put in practical use, the electrical connector 10 is mounted on the circuit board to be electrically connected with the electric circuit constituted on the same and, for example, put in engagement with a mate electrical connector functioning as a receptacle type connector mounted on another circuit board.

The electrical connector 10 has an insulating housing 11 made of insulator such as plastics or the like and a conductive shell member 12 made of metallic material to be put on the insulating housing 11 for shielding the electrical connector 10 from electromagnetic wave noises coming from the outside. A pair of engaging projections 13 are formed on the insulating housing 11 to be inserted respectively into a pair of engaging grooves formed on an insulating housing of the mate electrical connector (the receptacle type connector) with which the electrical connector 10 engages. Each of the engaging projections 13 elongates in a longitudinal direction of the insulating housing 11 and both of the engaging projections 13 are in parallel with each other. The insulating housing 11 is fixed to a surface of the circuit board on which the electrical connector 10 is mounted. The circuit board having the surface thereof to which the insulating housing 11 is fixed is not shown in FIGS. 1 and 2 but shown as a circuit board 40 in FIGS. 8, 9, 11 and 12 explained later.

The conductive shell member 12 is provided to surround the insulating housing 11 on the circuit board 40 so as to cover partially the outside of each of the engaging projections 13 formed on the insulating housing 11. A pair of board-connecting portions 12*a* are provided at each of end portions of the conductive shell member 12 in the longitudinal direction of the insulating housing 11 so as to be electrically connected by means of soldering with a grounding portion 25 (shown in FIGS. 6 and 7 explained later) of the circuit board 40. Further, a plurality of ground connecting reed-like portions 14 are provided on a portion of the conductive shell member 12 located between the board-connecting portions 12*a* provided respectively at the end portions of the conductive shell member 12 in the longitudinal direction of the insulating housing 11 so as to be electrically connected by means of soldering respectively with ground terminals 26 (shown in FIGS. 6 and 7 explained later) provided on the circuit board 40 to be included in the grounding portion 25 of the circuit board 40.

A plurality of signal contacts 15 are arranged on the insulating housing 11 at regular intervals along the longitudinal direction of the insulating housing 11. Further, a plurality of ground contacts 16 are provided on the insulating housing 11 at predetermined intervals in an arrangement of the signal contacts 15. For example, at least one of the signal contacts 15 is put between each two of the ground contacts 16 adjacent to each other.

Each of the signal contacts 15 is formed on the whole into a resilient conductive bent strip by means of, for example, punching and bending upon resilient metallic plate material, and each of the ground contacts 16 is also formed on the whole into a resilient conductive bent strip by means of, for example, punching and bending upon resilient metallic plate material.

Figure 3:
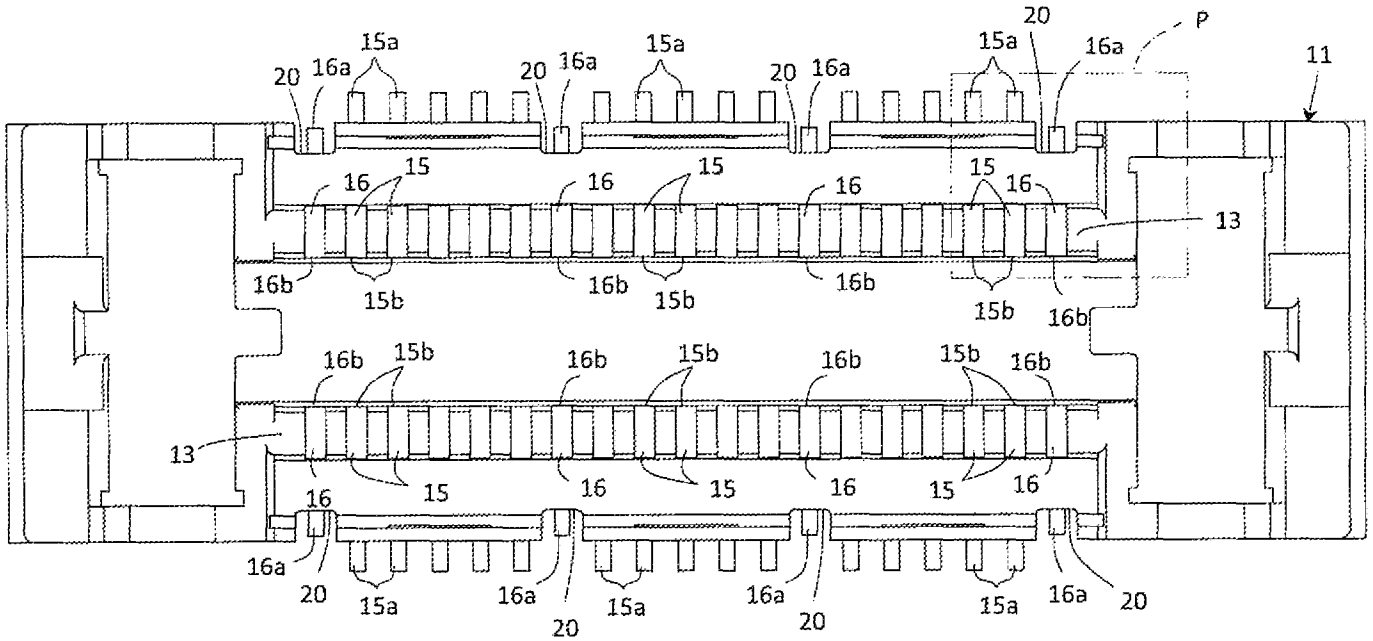
FIG. 3 is a schematic plan view showing the embodiment of electrical connector for use with a circuit board according to the present invention, from which a conductive shell member has been removed.
Figure 4:
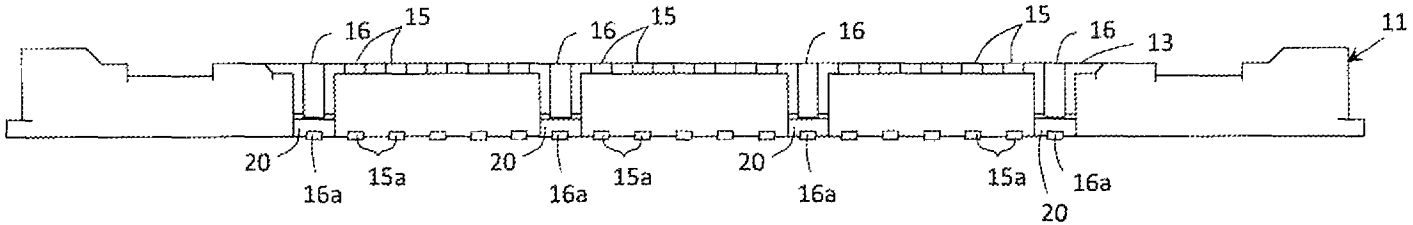
FIG. 4 is a schematic front view showing the embodiment of electrical connector for use with a circuit board according to the present invention from which the conductive shell member has been removed.

FIGS. 3 and 4 show the electrical connector 10 shown in FIGS. 1 and 2 from which the conductive shell member 12 has been removed.

Referring to FIGS. 3 and 4, each of the signal contacts 15 arranged on the insulating housing 11 along the longitudinal direction of the same has a signal connecting terminal 15*a* provided to be electrically connected by means of soldering with a signal terminal 27 (shown in FIGS. 6 and 7 explained later) provided on the circuit board 40 (not shown in FIGS. 3 and 4) and a signal contacting portion 15*b* put on the engaging projection 13 formed on the insulating housing 11 for coming into contact with a mate signal contact in the mate electrical connector (the receptacle type connector) with which the electrical connector 10 engages. Further, each of the ground contacts 16 provided on the insulating housing 11 at predetermined intervals in the arrangement of the signal contacts 15 has a ground connecting terminal 16*a* provided to be electrically connected with the ground terminal 26 provided on the circuit board 40 to be included in the grounding portion 25 of the circuit board 40 and a ground contacting portion 16*b* put on the engaging projection 13 formed on the insulating housing 11 for coming into contact with a mate ground contact in the mate electrical connector (the receptacle type connector) with which the electrical connector 10 engages.

As shown in FIG. 2, a plurality of recesses 12*b* for preventing the conductive shell member 12 from coming into contact with the signal connecting terminal 15*a* of each of the signal contacts 15 are formed respectively on portions of the conductive shell member 12 each adjacent to the ground connecting reed-like portion 14. Each of the recesses 12*b* is provided to range over several of the signal contacts 15 arranged along the longitudinal direction of the insulating housing 11.

Figure 5:
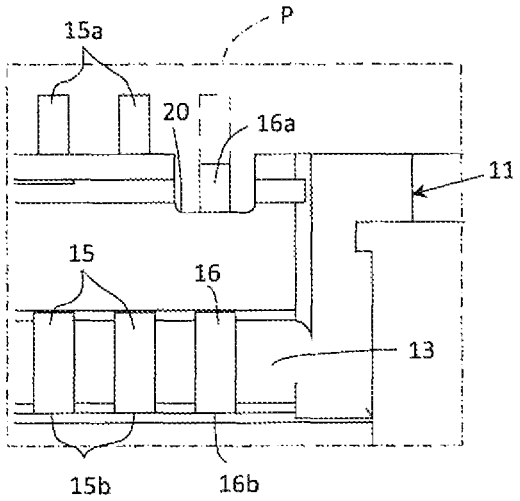
FIG. 5 is a schematic enlarged partial plane view showing a part of the embodiment of electrical connector for use with a circuit board without the conductive shell member put in a dot and dash line frame shown in FIG. 3.

As shown in FIG. 5 which shows an enlarged part of the electrical connector 10 without the conductive shell member 12 put in a dot and dash line frame shown in FIG. 3, a recess 20 is formed on a portion of the insulating housing 11 located at the outside of the engaging projection 13 to correspond to the ground connecting terminal 16*a* of the ground contact 16. The signal connecting terminal 15*a* of the signal contact 15 extends to go out of the insulating housing 11 from the portion of the insulating housing 11 located at the outside of the engaging projection 13 and, on the other hand, the ground connecting terminal 16*a* of the ground contact 16 extends to go out of the insulating housing 11 at the recess 20. The ground contact 16 having the ground connecting terminal 16*a* thus provided thereon is constituted, for example, by means of transforming one of a plurality of contact forming members arranged on the insulating housing 11 along the longitudinal direction of the same to be formed into the signal contacts 15 so as to have the ground connecting terminal 16*a* in place of the signal connecting terminal 15*a*. That is, the ground contacts 16 each having the ground connecting terminal 16*a*, are constituted, for example, with several of the contact forming members arranged on the insulating housing 11 along the longitudinal direction of the same to be formed into the signal contacts 15, each of which is transformed to have the ground connecting terminal 16*a* in place of the signal connecting terminal 15*a*.

On that occasion, the ground contact 16 having the ground connecting terminal 16*a* as described above is formed by means of cutting out a portion of one of the contact forming members provided to be formed into the signal connecting terminal 15*a* and shaping an end portion of the rest of said one of the contact forming members into the ground connecting terminal 16*a* and therefore, so to speak, a selected one of the signal contacts 15 can be transformed to the ground contact 16. As a result, the contact forming members can be arranged on the insulating housing 11 in common to the signal contacts 15 and the ground contacts 16 and this results in that the contact forming members can be put in easy management and thereby the electrical connector 10 is improved in its manufacturing efficiency.

Figure 6:
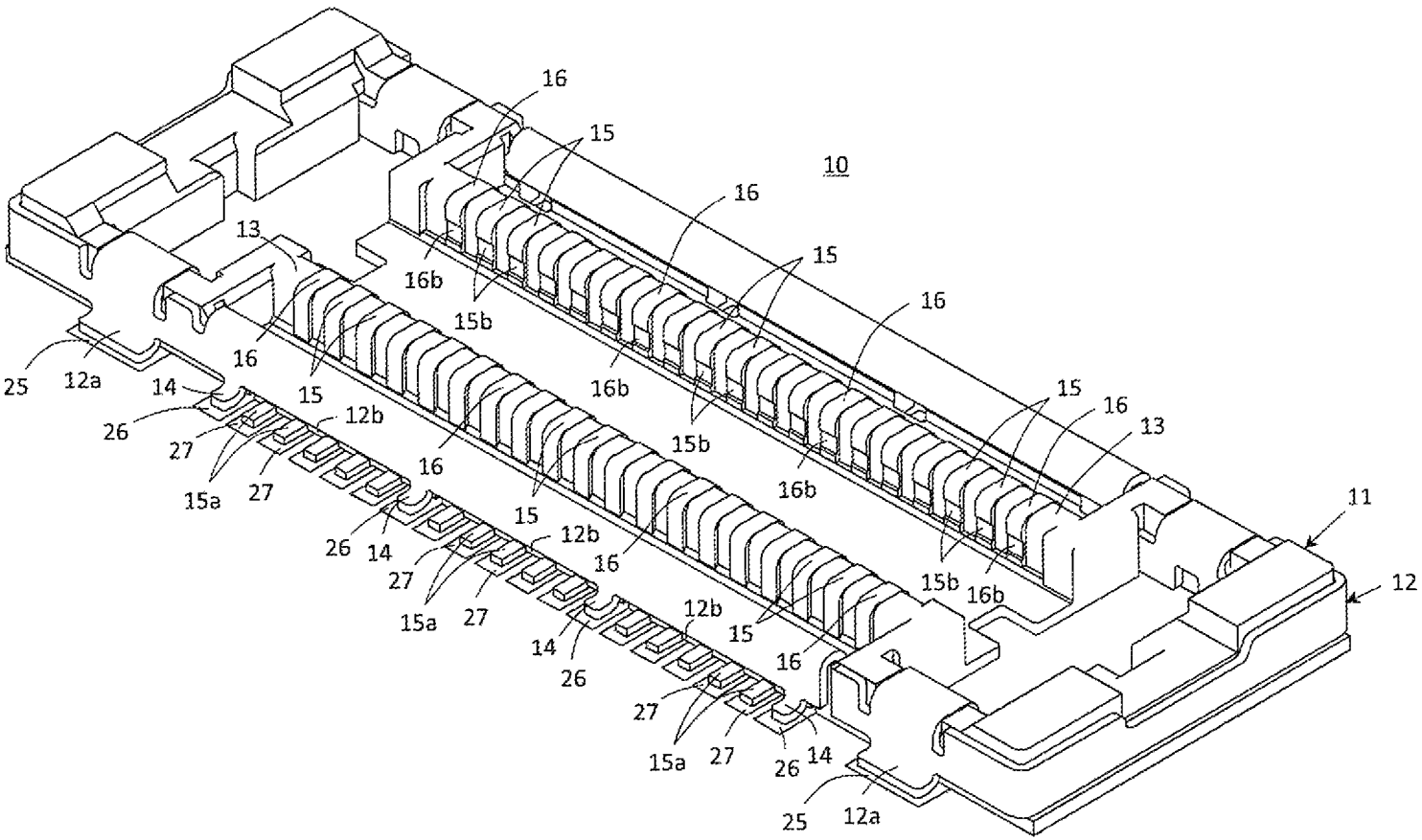
FIG. 6 is a schematic perspective view showing the embodiment of electrical connector for use with a circuit board according to the present invention mounted on a circuit board.
Figure 7:
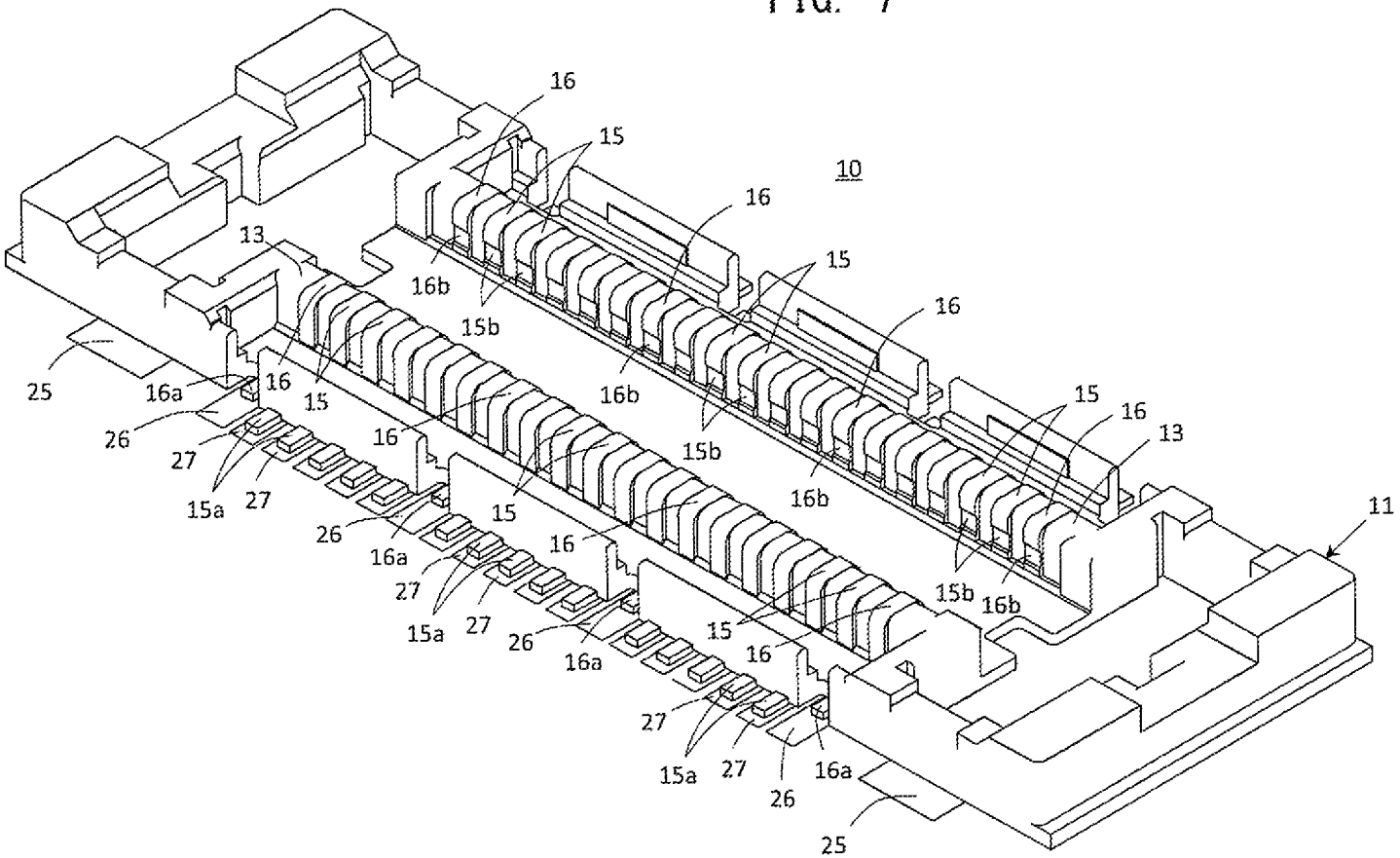
FIG. 7 is a schematic perspective view showing the embodiment of electrical connector for use with a circuit board according to the present invention mounted on the circuit board from which the conductive shell member has been removed.

FIG. 6 shows the electrical connector 10 which is mounted on the circuit board 40 (not shown in FIG. 6) and FIG. 7 shows the electrical connector 10 which is mounted on the circuit board 40 (not shown in FIG. 7) and from which the conductive shell member 12 is removed.

Figure 8:
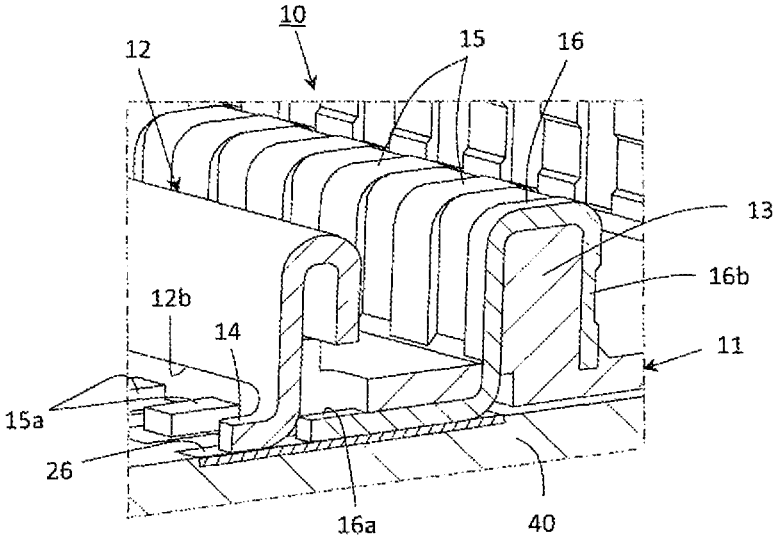
FIG. 8 is a schematic partial perspective and cross-sectional view showing a part of the embodiment of electrical connector for use with a circuit board according to the present invention mounted on the circuit board.

As shown in FIGS. 6 and 7, when the electrical connector 10 is mounted on the circuit board 40, each of the board-connecting portions 12*a* provided respectively at the end portions of the conductive shell member 12 in the longitudinal direction of the insulating housing 11 is electrically connected by means of soldering with the grounding portion 25 of the circuit board 40 and, as shown also in FIG. 8, each of the ground connecting reed-like portions 14 provided respectively on the portions of the conductive shell member 12 located between the board-connecting portions 12*a* is electrically connected by means of soldering with one of the ground terminals 26 provided on the circuit board 40 to be included in the grounding portion 25 of the circuit board 40.

Figure 9:
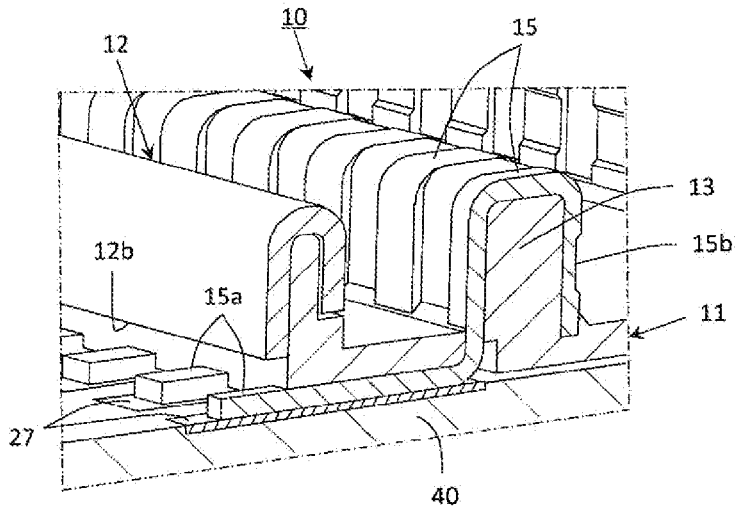
FIG. 9 is a schematic partial perspective and cross-sectional view showing another part of the embodiment of electrical connector for use with a circuit board according to the present invention mounted on the circuit board.

Further, as shown also in FIG. 9, the signal connecting terminal 15*a* of each of the signal contacts 15 arranged on the insulating housing 11 along the longitudinal direction of the same is electrically connected by means of soldering with one of the signal terminals 27 provided on the circuit board 40 and, as shown in FIGS. 7 and 8, the ground connecting terminal 16*a* of each of the ground contacts 16 provided on the insulating housing 11 at predetermined intervals in the arrangement of the signal contacts 15 is electrically connected by means of soldering with the ground terminal 26 provided on the circuit board 40 to be included in the grounding portion 25 of the circuit board 40, with which the ground connecting reed-like portion 14 provided on the conductive shell member 12 is also electrically connected by means of soldering. This means that each of the ground terminals 26 is provided on the circuit board 40 in common to both of the ground connecting reed-like portion 14 provided on the conductive shell member 12 and the ground connecting terminal 16*a* of the ground contacts 16. That is, the ground connecting reed-like portion 14 provided on the conductive shell member 12 and the ground connecting terminal 16*a* of the ground contact 16 are electrically connected by means of soldering with the ground terminal 26 which is provided on the circuit board 40 in common to both of the ground connecting reed-like portion 14 provided on the conductive shell member 12 and the ground connecting terminal 16*a* of the ground contacts 16.

With the ground connecting reed-like portions 14 provided on the conductive shell member 12 to be electrically connected by means of soldering, together with the ground connecting terminal 16*a* of the ground contact 16, with the ground terminal 26 provided on the circuit board 40 in common to both of the ground connecting reed-like portion 14 and the ground connecting terminal 16*a* as described above, the conductive shell member 12 is supplied with a ground potential at not only the end portions thereof, at each of which the board-connecting portion 12*a* is provided, but also the portions thereof located between the end portions, on each of which the ground connecting reed-like portion 14 is provided.

Figure 10:
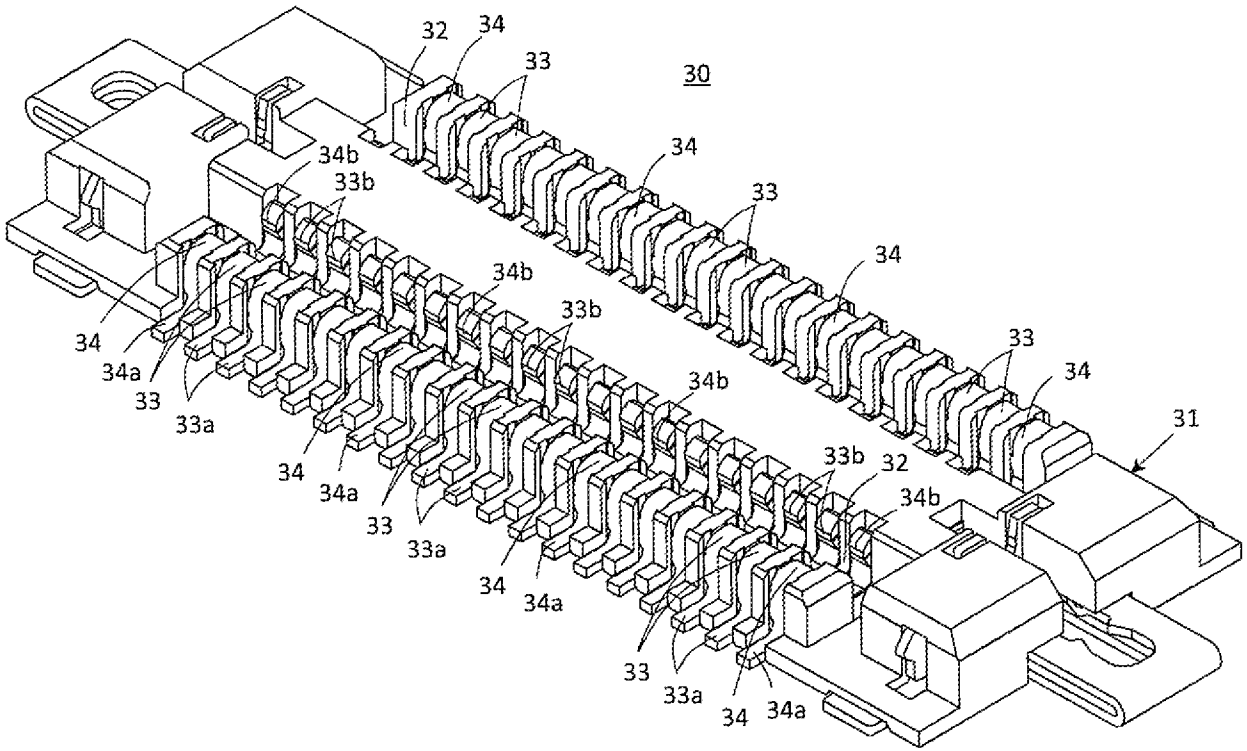
FIG. 10 is a schematic perspective view showing an example of a mate electrical connector with which the embodiment of electrical connector for use with a circuit board according to the present invention is put in engagement.

FIG. 10 shows an example of the mate electrical connector with which the electrical connector 10 engages.

Referring to FIG. 10, a mate electrical connector 30, which constitutes the example of the mate electrical connector, is provided to be used as a receptacle type connector mounted on a circuit board on which an electric circuit is formed. The mate electrical connector 30 has an insulating housing 31 made of insulator such as plastics or the like. A pair of engaging grooves 32, into which the engaging projections 13 formed on the insulating housing 11 of the electrical connector 10 are inserted respectively, are formed on the insulating housing 31. Each of the engaging grooves 32 elongates in a longitudinal direction of the insulating housing 31 and both of the engaging grooves 32 are in parallel with each other. The insulating housing 31 is fixed to a surface of the circuit board on which the mate electrical connector 30 is mounted. The circuit board having the surface thereof to which the insulating housing 31 is fixed is not shown in FIG. 10 but shown as a circuit board 50 in FIGS. 11 and 12 explained later.

A plurality of mate signal contacts 33 are provided to be arranged on a portion of the insulating housing 31, on which the engaging grooves 32 are formed, at regular intervals along the longitudinal direction of the insulating housing 31. Further, a plurality of mate ground contacts 34 are provided on the portion of the insulating housing 31, on which the engaging grooves 32 are formed, at predetermined intervals in an arrangement of the mate signal contacts 33. Therefore, the mate signal contacts 33 and the mate ground contacts 34 are arranged on the insulating housing 31 along the longitudinal direction of the insulating housing 31.

Each of the mate signal contacts 33 is formed on the whole into a resilient conductive bent strip by means of, for example, punching and bending upon resilient metallic plate material, and each of the mate ground contacts 34 is also formed on the whole into a resilient conductive bent strip by means of, for example, punching and bending upon resilient metallic plate material.

Each of the mate signal contacts 33 arranged on the insulating housing 31 along the longitudinal direction of the same has a signal connecting terminal 33*a* provided to be electrically connected by means of soldering with a signal terminal 35 (shown in FIG. 11 explained later) provided on the circuit board 50 and a signal contacting point 33*b* put in the engaging groove 32 formed on the insulating housing 31 for coming into press-contact with the signal contacting portion 15*b* of each of the signal contacts 15 in the electrical connector 10. Further, each of the mate ground contacts 34 provided on the insulating housing 31 at predetermined intervals in the arrangement of the mate signal contacts 33 has a ground connecting terminal 34*a* provided to be electrically connected with a ground terminal 36 (shown in FIG. 12 explained later) provided on the circuit board 50 and a ground contacting point 34*b* put in the engaging groove 32 formed on the insulating housing 31 for coming into press-contact with the ground contacting portion 16*b* of each of the ground contact 16 in the electrical connector 10.

When the electrical connector 10 mounted on the circuit board 40 is put in engagement with the mate electrical connector 30 mounted on the circuit board 50, the engaging projections 13 formed on the insulating housing 11 of the electrical connector 10 are inserted respectively into the engaging grooves 32 formed on the insulating housing 31 of the mate electrical connector 30, so that the circuit boards 40 and 50 are put in a condition of electrical piling connection.

Figure 11:
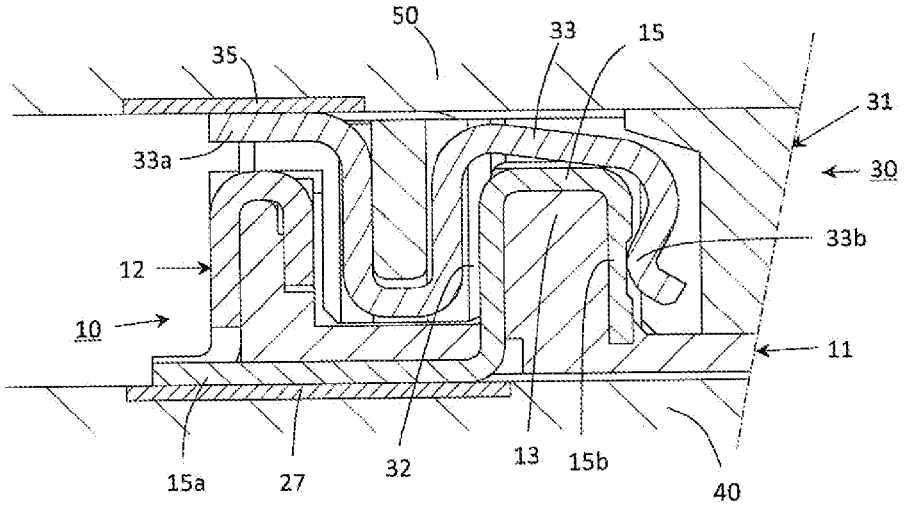
FIG. 11 is a schematic partial cross-sectional view showing a part of the embodiment of electrical connector for use with a circuit board according to the present invention put in engagement with the mate electrical connector.

On that occasion, as shown in FIG. 11, the signal contacting point 33*b* of each of the mate signal contacts 33 in the mate electrical connector 30 comes into press-contact with the signal contacting portion 15*b* of a corresponding one of the signal contacts 15 in the electrical connector 10. Thereby, each of the mate signal contacts 33 in the mate electrical connector 30 and the corresponding one of the signal contacts 15 in the electrical connector 10 are put in mutual electrical connection, so that the signal terminals 27 provided on the circuit board 40 on which the electrical connector 10 is mounted are electrically connected respectively with the signal terminals 35 provided on the circuit board 50 on which the mate electrical connector 30 is mounted through the signal contacts 15 in the electrical connector 10 and the mate signal contacts 33 in the mate electrical connector 30.

Figure 12:
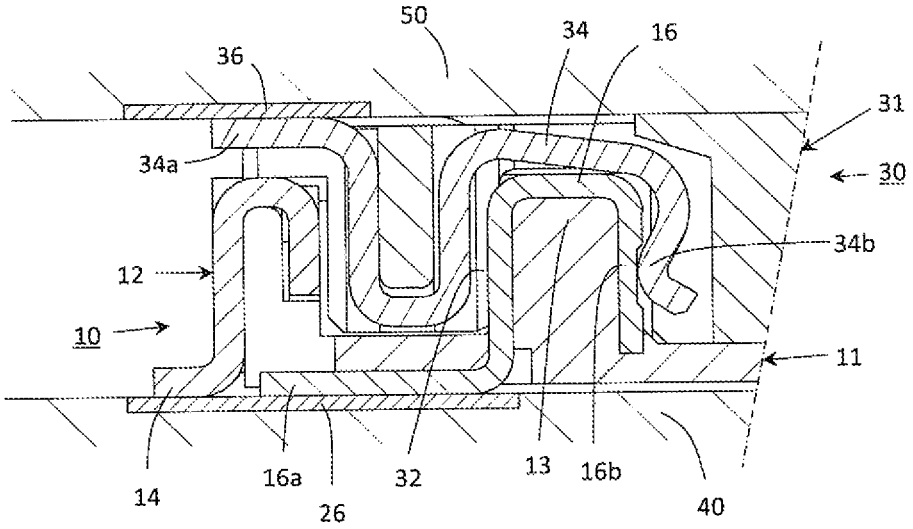
FIG. 12 is a schematic partial cross-sectional view showing another part of the embodiment of electrical connector for use with a circuit board according to the present invention put in engagement with the mate electrical connector.

Further, as shown in FIG. 12, the ground contacting point 34*b* of each of the mate ground contacts 34 in the mate electrical connector 30 comes into press-contact with the ground contacting portion 16*b* of a corresponding one of the ground contacts 16 in the electrical connector 10. Thereby, each of the mate ground contacts 34 in the mate electrical connector 30 and the corresponding one of the ground contacts 16 in the electrical connector 10 are put in mutual electrical connection, so that the ground terminals 26 provided on the circuit board 40 on which the electrical connector 10 is mounted are electrically connected respectively with the ground terminals 36 provided on the circuit board 50 on which the mate electrical connector 30 is mounted through the ground contacts 16 in the electrical connector 10 and the mate ground contacts 34 in the mate electrical connector 30.

Under such a condition as described above, the conductive shell member 12 of the electrical connector 10 is supplied through the board- connecting portions 12*a* and the ground connecting reed-like portions 14 with the ground potential from the grounding portion 25 including the ground terminals 26 provided on the circuit board 40 on which the electrical connector 10 is mounted. Accordingly, the conductive shell member 12 of the electrical connector 10 is operative to shield the signal contacts 15 in the electrical connector 10 and the mate signal contacts 33 in the mate electrical connector 30 from electromagnetic wave noises coming from the outside.

With the electrical connector 10 as described above, the conductive shell member 12 provided for covering partially the outside of the engaging projections 13 formed on the insulating housing 11 has the ground connecting reed-like portions 14, each of which is formed on the portion of the conductive shell member 12 corresponding to the ground connecting terminal 16*a* of the ground contact 16 between the end portions of the conductive shell member 12 in the direction along which the signal contacts 15 are arranged so as to be electrically connected by means of soldering, together with the ground connecting terminal 16*a* of the ground contact 16, with the ground terminal 26 included in the grounding portion 25 of the circuit board 40 to which the insulating housing 11 is fixed, so that the portion of the conductive shell member 12, on which the ground connecting reed-like portion 14 is formed and which is located between the end portions of the conductive shell member 12 in the direction along which the signal contacts 15 are arranged, is supplied with the ground potential through the ground connecting reed-like portion 14 from the ground terminal 26 provided on the circuit board 40. Accordingly, the conductive shell member 12 having the ground connecting reed-like portions 14 can be put in a condition wherein the end portions of the conductive shell member 12 in the direction along which the signal contacts 15 are arranged are electrically connected with the grounding portion 25 of the circuit board 40 to which the insulating housing 11 is fixed and, in addition, the portions of the conductive shell member 12, on each of which the ground connecting reed-like portion 14 is formed and which are located between the end portions of the conductive shell member 12 in the direction along which the signal contacts 15 are arranged, are electrically connected respectively with the ground terminals 26 included in the grounding portion 25 of the circuit board 40, so that the conductive shell member 12 is supplied with the ground potential at the end portions thereof in the direction along which the signal contacts 15 are arranged and the portions thereof located between the end portions. This results in that the conductive shell member 12 presents a superior grounding characteristic to the signal contacts 15 on the insulating housing 11.

Further, with the electrical connector 10, since the ground connecting reed-like portions 14 are formed respectively on the portions of the conductive shell member 12, each of which corresponds to the ground connecting terminal 16*a* of each of the ground contacts 16 put on the insulating housing 11 to be electrically connected by means of soldering, together with the ground connecting terminal 16*a* of the ground contact 16, with the ground terminal 26 provided on the circuit board 40 to which the insulating housing 11 is fixed to be common to the ground connecting reed-like portion 14 of the conductive shell member 12 and the ground connecting terminal 16*a* of the ground contact 16 and thereby the portions of the conductive shell member 12, on which the ground connecting reed-like portions 14 are formed respectively and which are located between the end portions of the conductive shell member 12 in the direction along which the signal contacts 15 are arranged, are electrically connected with the grounding portion 25 of the circuit board 40, the portions of the conductive shell member 12 located between the end portions of the same in the direction along which the signal contacts 15 are arranged can be reliably and stably connected electrically with the grounding portion 25 of the circuit board 40 on which the insulating housing 11 is fixed.

Besides, with the electrical connector 10, since each of the ground connecting terminal 16*a* of the ground contact 16 and the ground connecting reed-like portion 14 of the conductive shell member 12 is not subjected to any positional restriction in the arrangement of the signal contacts 15, an optional portion of the conductive shell member 12 selected in response to a position of the ground terminal 26 included in the grounding portion 25 of the circuit board 40 to which the insulating housing 11 is fixed can be electrically connected with the grounding portion 25 of the circuit board 40.

The invention claimed is:

1. An electrical connector for use with a circuit board comprising;

an insulating housing provided with an engaging projection formed thereon to elongate in a predetermined direction for engaging with a mate electrical connector and used to be fixed to a circuit board, a plurality of signal contacts arranged along the predetermined direction on the insulating housing, each of which has a signal connecting terminal provided to extend along a surface of the circuit board and to be connected with a signal terminal provided on the surface of the circuit board and a signal contacting portion put on the engaging projection formed on the insulating housing for coming into contact with a mate signal contact in the mate electrical connector, at least one ground contact provided in an arrangement of the signal contacts on the insulating housing, which has a ground connecting terminal provided to be connected with a ground terminal provided on the surface of the circuit board and a ground contacting portion put on the engaging projection formed on the insulating housing for coming into contact with a mate ground contact in the mate electrical connector, and a conductive shell member provided for covering partially a portion of the insulating housing positioned at the outside of the engaging projection formed on the insulating housing and to be connected with a grounding portion of the circuit board including the ground terminal provided on the circuit board, wherein the ground contact is formed by transforming one of a plurality of contact forming members which are arranged on the insulating housing to be formed into the signal contacts so as to have the ground connecting terminal in place of the signal connecting terminal, said ground connecting terminal extending along the surface of the circuit board and is smaller in length than the signal connecting terminal, wherein the conductive shell member has a ground connecting reed-like portion formed thereon to extend along the surface of the circuit board and to correspond to the ground connecting terminal of the ground contact, and wherein the ground connecting reed-like portion of the conductive shell member and the ground connecting terminal of the ground contact are aligned in a direction perpendicular to the predetermined direction on the surface of the circuit board to be connected by soldering with the ground terminal provided on the surface of the circuit board and common to both of the ground connecting reed-like portion of the conductive shell member and the ground connecting terminal of the ground contact.

2. An electrical connector for use with a circuit board according to claim 1, wherein the ground contact is provided at each of locations at predetermined intervals in the arrangement of the signal contacts on the insulating housing and the ground connecting reed-like portion is formed on each of a plurality of portions of the conductive shell member each corresponding to the ground connecting terminal of the ground contact.

3. An electrical connector for use with a circuit board according to claim 1, wherein a recess for preventing the conductive shell member from coming into contact with the signal connecting terminal of each of the signal contacts is formed on a portion of the conductive shell member adjacent to the ground connecting reed-like portion to range over the signal contacts arranged along the predetermined direction on the insulating housing.

* * * * *